US008025034B2

(12) United States Patent
Winstead

(10) Patent No.: US 8,025,034 B2
(45) Date of Patent: Sep. 27, 2011

(54) INTERVAL PHASING FOR VALVE TIMING

(75) Inventor: Vince Winstead, Mankato, MN (US)

(73) Assignee: Ford Global Technologies, LLC, Dearborn, MI (US)

( * ) Notice: Subject to any disclaimer, the term of this patent is extended or adjusted under 35 U.S.C. 154(b) by 587 days.

(21) Appl. No.: 11/620,503

(22) Filed: Jan. 5, 2007

(65) Prior Publication Data

US 2008/0163835 A1 Jul. 10, 2008

(51) Int. Cl.
*F01L 9/04* (2006.01)

(52) U.S. Cl. ..... 123/90.11; 123/90.15

(58) Field of Classification Search ..... 123/90.11, 123/90.15; 251/129.01
See application file for complete search history.

(56) References Cited

U.S. PATENT DOCUMENTS

| | | | | |
|---|---|---|---|---|
| 6,502,543 | B1 | 1/2003 | Arai et al. | |
| 6,866,012 | B2 | 3/2005 | Hayase et al. | |
| 2005/0160425 | A1 * | 7/2005 | Falsett et al. | 718/100 |
| 2006/0247831 | A1 * | 11/2006 | Shimokoshi | 701/29 |
| 2007/0051342 | A1 * | 3/2007 | Kita | 123/436 |

* cited by examiner

*Primary Examiner* — Zelalem Eshete
(74) *Attorney, Agent, or Firm* — Allan J. Lippa; Alleman Hall McCoy Russell & Tuttle LLP

(57) ABSTRACT

A system for communicating information between a valve controller and an engine controller is presented. The system is designed to improve the timing of data transferred between two controllers.

20 Claims, 7 Drawing Sheets

INTERVAL PHASING FOR VALVE TIMING

FIELD

The present application relates to controlling crank angle phasing and valve timing in an engine.

BACKGROUND

An internal combustion engine burns a mixture of fuel and oxidizer in a combustion chamber to create high temperature and pressure gases that expand to provide useful work. Some engines may use valves to control intake of oxidizer and sometimes fuel as well as to control exhaust gases. These engines conventionally use mechanically driven camshafts to actuate the valves and control combustion by the timing, duration and sometimes lift of the valves, thus controlling the intake and exhaust of air, fuel and exhaust gases.

Unfortunately, conventional mechanically driven camshafts provide the same timing, duration and lift of the valves under all engine operating conditions. For example, a camshaft may be designed to improve low engine speed torque but this also affects high engine speed horsepower, overall engine efficiency, exhaust emissions and noise, vibration and harshness (NVH). Due to these factors, variable valve timing cam driven systems have been designed to vary aspects of valve timing, duration, or lift based on engine operating speed. While these systems allow increased control over pumping losses, combustion parameters, volumetric efficiency, etc., these systems still provide sliding friction losses, typically only operate on a bank of cylinders and therefore do not individually control cylinders, and decrease overall efficiency by having to overcome valve spring forces.

Electromagnetic/electronic valve actuation (EVA) engines have been developed that use electromagnetic solenoid actuators to open and close valves, providing variable valve control without some of the detriments of cam operated variable valve systems. Valve timing may be computed based on intake and exhaust manifold pressures, air charge estimation, fuel charge estimation, driver demand, etc. EVA control allows for dynamic changes to valve timing based on calculations of these variables. One such electronically controlled variable valve timing system has been disclosed in U.S. Pat. No. 6,502,543, issued to Arai, et al.

In Arai, an intake-air quantity control apparatus advances intake valve closure timing if an intake-air quantity is above a threshold value, and adjusts a throttle opening if an intake-air quantity is below a threshold value, in order to adjust an actual intake-air quantity closer to a desired value. However, Arai uses a single control unit to receive measurements of engine operating conditions, calculate valve timing, and adjust a throttle opening with a throttle actuator. Use of one control unit may disrupt the response of the control unit to other functions and thus requires a lead time to calculate valve timing well in advance of actual valve open and close events.

In one approach, as described in U.S. Pat. No. 6,866,012 issued to Hayase, et al., a multiple control unit approach to distribute processing power for an EVA engine is described. In particular, Hayase provides a method and apparatus to assign a controller to a group of valves with non-overlapping opening periods while the internal combustion engine is operated in a low speed low load region to reduce operation noise. Additionally, Hayase provides dividing electromagnetically driven valves in an internal combustion engine into plural valve groups to minimize overlap of concentrated control periods for the valves, and controlling the valves in each of the valve groups using a single control body.

However, the inventors herein have recognized disadvantages with this approach. Specifically, when valve timing is initially computed in a master controller and sent to slave controllers, computation and transmission delays allow engine operating conditions such as manifold pressures, in-cylinder pressure, driver demands, etc., to change considerably by the time the valve timing information is used at a valve controller. Conversely, if the valve timing information is too up to date, it will not reach the valve controller within a meaningful time to allow actuation before the corresponding cylinder combustion event. A conventional approach provides valve timing updates every 900 degrees of crank rotation in order to not be too late to be relevant or too early to be calculated. However, in such a degree based delay approach, timing information is fast at a slow engine speed and slow at a fast engine speed.

The inventors herein have recognized the above-mentioned disadvantages and have developed a system that improves communication and data exchange between a valve controller and an engine controller.

SUMMARY

One example approach to overcome at least some of the disadvantages of prior approach includes measuring an engine speed, determining a latency time required to calculate and transmit a first valve timing to a valve controller, determining a first crank angle phasing based on the latency time and measured engine speed to send the first valve timing to the valve controller, determining a second crank angle phasing based on the latency time and measured engine speed to send a second valve timing to update the valve controller, and transmitting the first valve timing to the valve controller according to the first crank angle phasing and transmitting the second valve timing to the valve controller according to the second crank angle phasing.

In a second approach, also described herein, the above issues may be addressed by a system with at least one cylinder with an intake valve and an exhaust valve, a valve controller operably coupled to the intake and exhaust valve, said controller to adjust the valve timing of at least one of the intake and exhaust valve, and a master controller connected to the slave controller with a link, the master controller to compute a latency time required to calculate and transmit a first valve timing to a valve controller, determine a first crank angle phasing based on the latency time and current engine speed to send the first valve timing to the valve controller, determine a second crank angle phasing based on the latency time and engine speed to send a second valve timing to update the valve controller, and transmit the first valve timing to the valve controller according to the first crank angle phasing and transmit the second valve timing to the valve controller according to the second crank angle phasing.

In another example approach, also described herein, the above issues bay be addressed by to measuring an engine speed of an internal combustion engine having a plurality of cylinders using electronic valve actuation, determining a latency time required to calculate and transmit valve timing information to a valve controller, determining a crank angle phasing based on the latency time and measured engine speed to send the valve timing information to the valve controller, calculating valve timing information based on an engine operating condition, and transmitting the valve timing information to the valve controller according to the determined crank angle phasing.

The present description provides several advantages. In particular, the method adjusts the amount of time available to transmit engine data during a cycle of an engine to allow calculation of valve timing closer to an actual combustion event to improve efficiency and power and reduce emissions. Another advantage is reducing aircharge delivery latencies which may impact or disrupt idle speed control. The above advantages and other advantages, and features of the present description will be readily apparent from the following Detailed Description when taken alone or in connection with the accompanying drawings.

DETAILED DESCRIPTION

Figure 1:
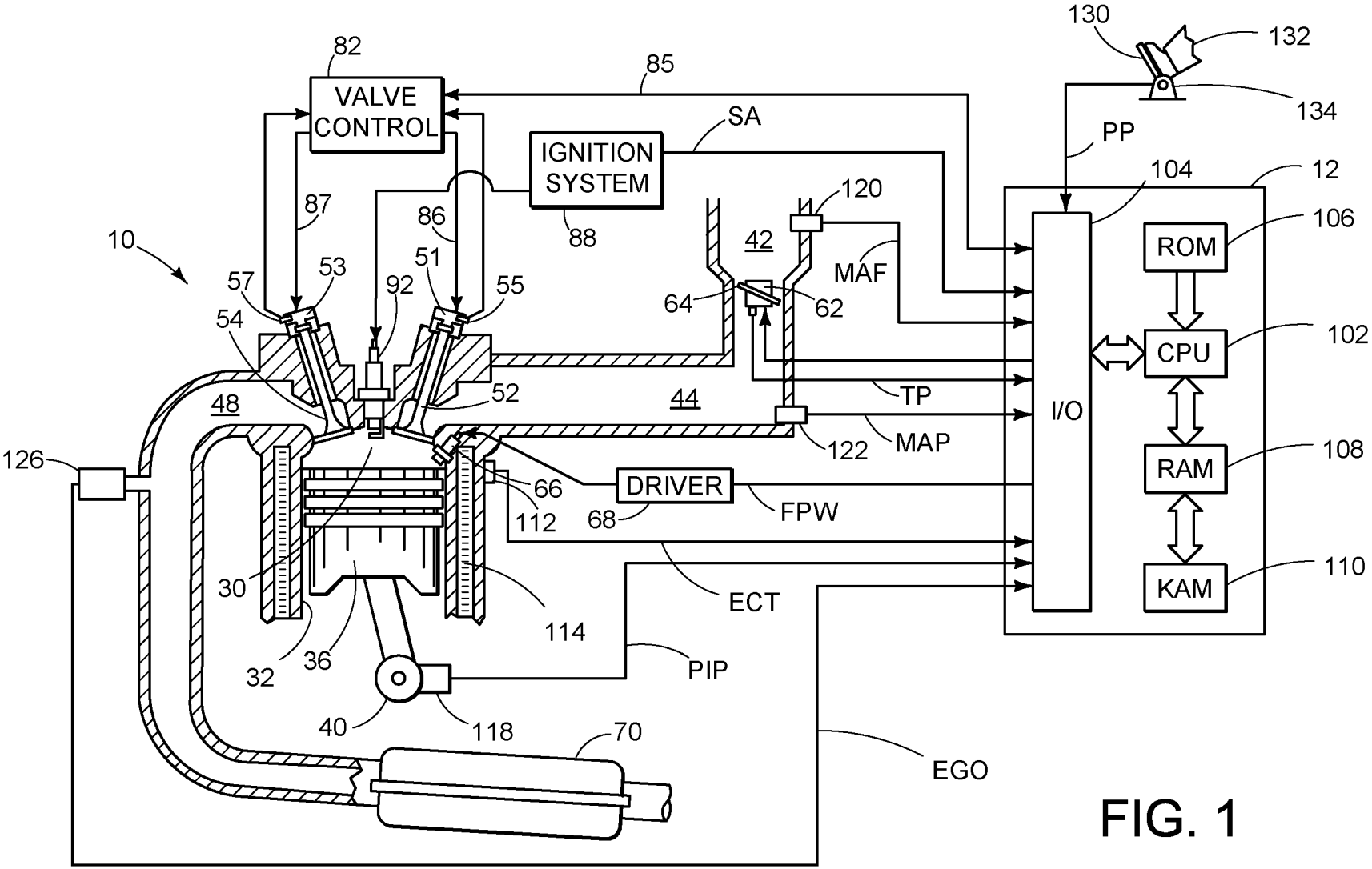
FIG. 1 is a schematic diagram of a portion of an example internal combustion engine.

FIG. 1 is a schematic diagram showing one cylinder of multi-cylinder engine 10, which may be included in a propulsion system of an automobile. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Combustion chamber (i.e. cylinder) 30 of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of the passenger vehicle via a transmission system. Further, a starter motor may be coupled to crankshaft 40 via a flywheel to enable a starting operation of engine 10.

Combustion chamber 30 may receive intake air from intake passage 44 via intake manifold 42 and may exhaust combustion gases via exhaust passage 48. Intake passage 44 and exhaust passage 48 can selectively communicate with combustion chamber 30 via respective intake valve 52 and exhaust valve 54. In some embodiments, combustion chamber 30 may include two or more intake valves and/or two or more exhaust valves.

Intake valve 52 may be controlled by controller 12 via valve controller 82 and electric valve actuator (EVA) 51. Valve controller 82, also called a slave controller or valve control unit (VCU), is shown coupled with controller 12 over link 85, but other embodiments may include more than 1 valve controller 82. In some embodiments link 85 is a high speed control area network (CAN) operating at 500 kbit/sec data bandwidth, but embodiments are not so limited and may operate at other speeds or may be other communication channels that adequately provide data transfer between controller 12 and one or more valve controllers 82. Valve controller 82 is in communication with electronic valve actuators 51 and 53 through links 86 and 87 and controls the opening and closing of the respective intake valve 52 and exhaust valve 54. Similarly, exhaust valve 54 may be controlled by controller 12 via valve controller 82 and EVA 53.

During some conditions, valve controller 82 may vary the signals provided to actuators 51 and 53 to control the opening and closing of the respective intake and exhaust valves. The position of intake valve 52 and exhaust valve 54 may be determined by valve position sensors 55 and 57, respectively. In alternative embodiments, one or more of the intake and exhaust valves may be actuated by one or more cams, and may utilize one or more of cam profile switching (CPS), variable cam timing (VCT), variable valve timing (VVT) and/or variable valve lift (VVL) systems to vary valve operation. For example, cylinder 30 may alternatively include an intake valve controlled via electric valve actuation and an exhaust valve controlled via cam actuation including CPS and/or VCT.

Fuel injector 66 is shown coupled directly to combustion chamber 30 for injecting fuel directly therein in proportion to the pulse width of signal FPW received from controller 12 via electronic driver 68. In this manner, fuel injector 66 provides what is known as direct injection of fuel into combustion chamber 30. The fuel injector may be mounted in the side of the combustion chamber or in the top of the combustion chamber, for example.

Fuel may be delivered to fuel injector 66 by a fuel system (not shown) including a fuel tank, a fuel pump, and a fuel rail. In some embodiments, combustion chamber 30 may alternatively or additionally include a fuel injector arranged in intake passage 44 in a configuration that provides what is known as port injection of fuel into the intake port upstream of combustion chamber 30.

Intake manifold 42 may include a throttle 62 having a throttle plate 64. In this particular example, the position of throttle plate 64 may be varied by controller 12 via a signal provided to an electric motor or actuator included with throttle 62, a configuration that is commonly referred to as electronic throttle control (ETC). In this manner, throttle 62 may be operated to vary the intake air provided to combustion chamber 30 among other engine cylinders. The position of throttle plate 64 may be provided to controller 12 by throttle position signal TP. Intake manifold 42 may include a mass air flow sensor 120 and a manifold air pressure sensor 122 for providing respective signals MAF and MAP to controller 12.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark or spark plug 92.

Exhaust gas sensor 126 is shown coupled to exhaust passage 48 upstream of emission control device 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor.

Emission control device 70 is shown arranged along exhaust passage 48 downstream of exhaust gas sensor 126. Device 70 may be a three way catalyst (TWC), NOx trap, various other emission control devices, or combinations thereof. In some embodiments, during operation of engine 10, emission control device 70 may be periodically reset by operating at least one cylinder of the engine within a particular air/fuel ratio.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus.

Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from sensor 122. Engine speed signal, RPM, may be generated by controller 12 from signal PIP. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa.

During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses every revolution of the crankshaft. As described above, FIG. 1 shows only one cylinder of a multi-cylinder engine, and that each cylinder may similarly include its own set of intake/exhaust valves, fuel injector, spark plug, etc.

Figure 2B:
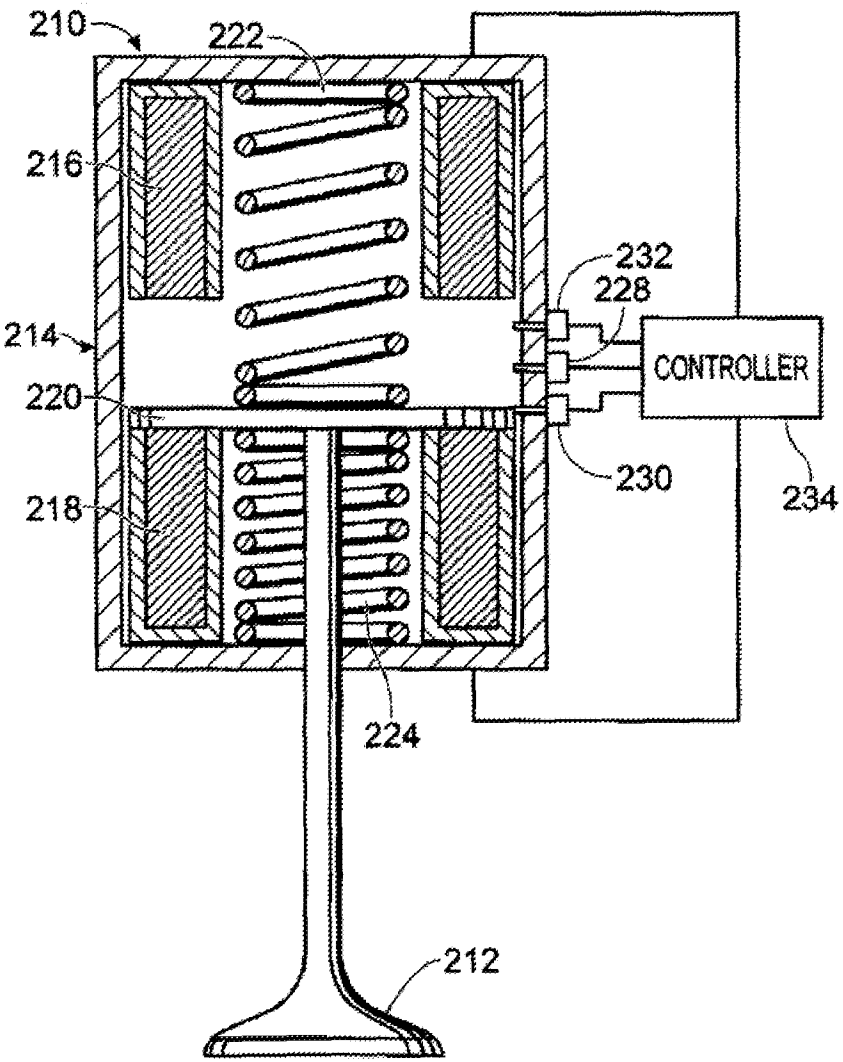
FIGS. 2A and 2B are schematic diagrams of an example electric valve actuation system in a first position and a second position.
Figure 2A:
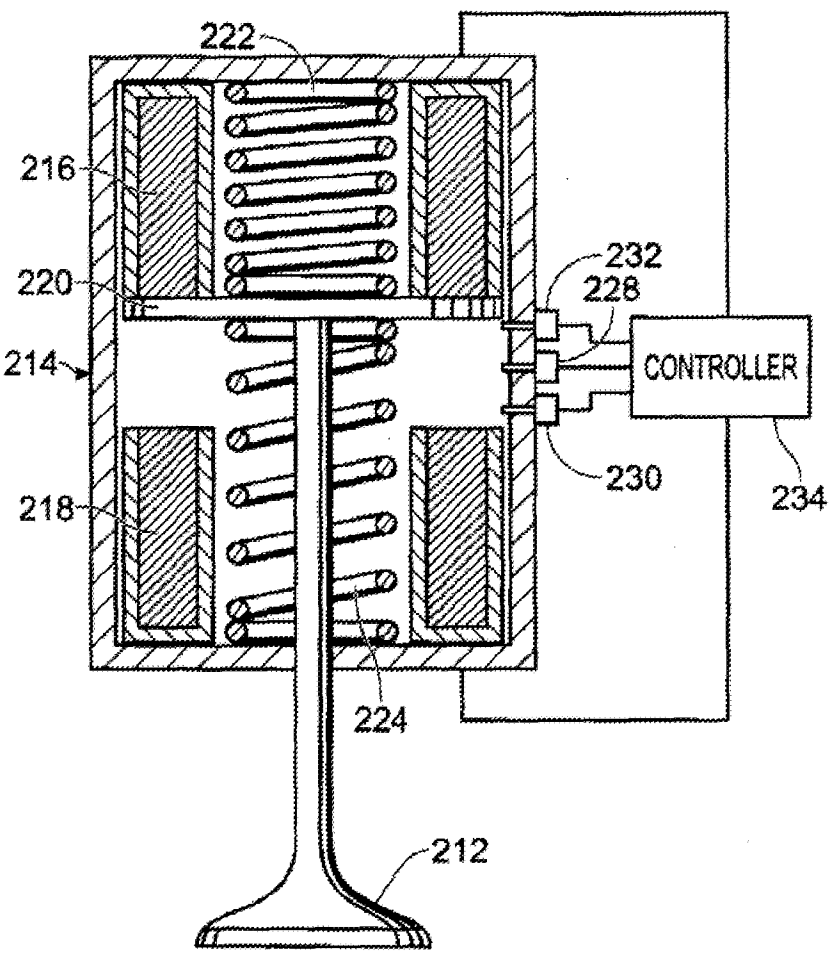
Figure 2C:
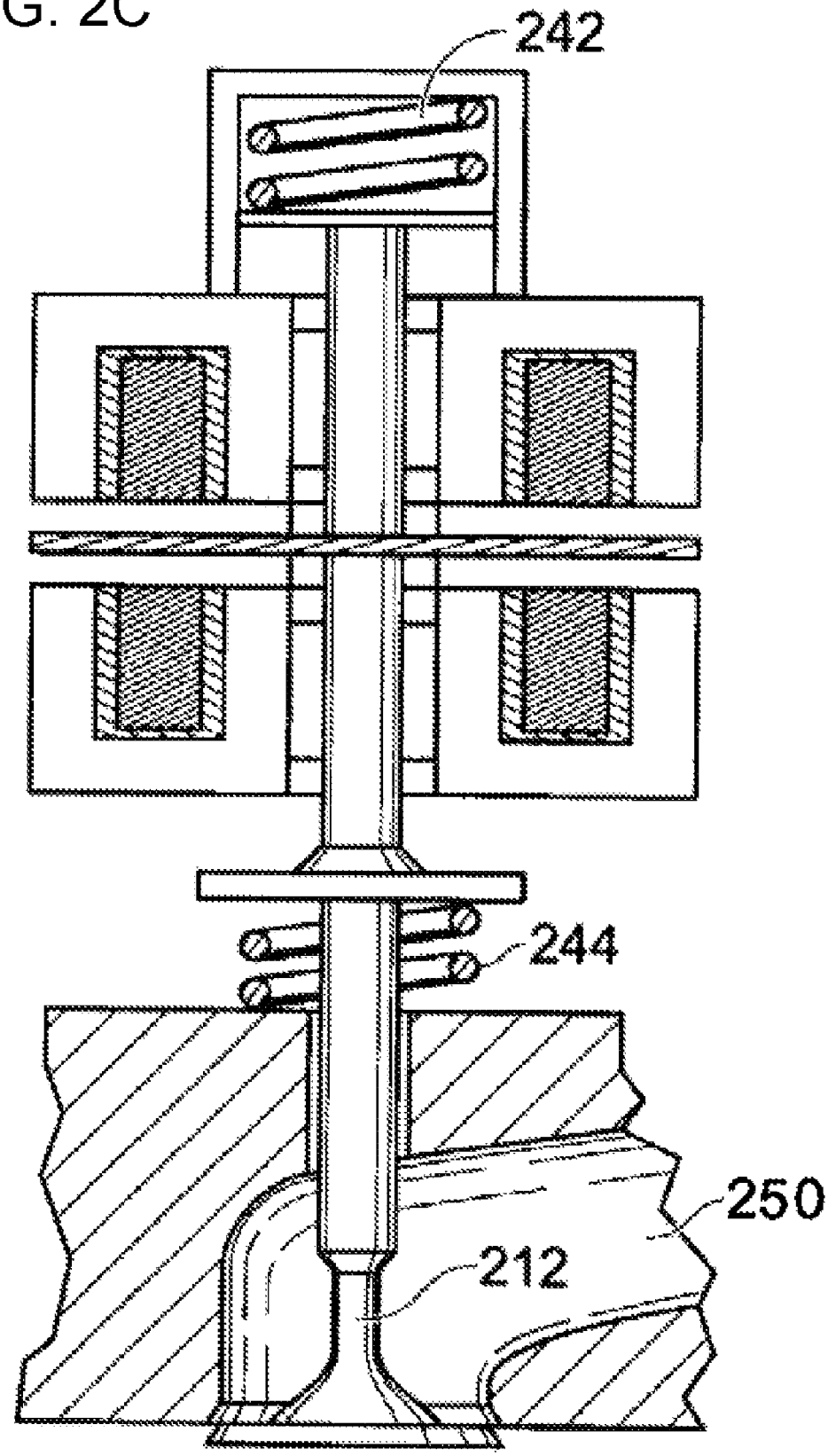
FIG. 2C is a schematic diagram of an example electric valve actuation system as further described in this disclosure.

FIGS. 2A, 2B, and 2C show a detailed view of an EVA system and valve that may be used as one of the intake or exhaust valves described above with reference to FIG. 1. Referring to FIGS. 2A and 2B, an EVA system 210 is shown for controlling movement of a valve 212 of a cylinder between a fully closed position (shown in FIG. 2A), and a fully open position (shown in FIG. 2B). The apparatus 210 includes an electric valve actuator (EVA) 214 with upper and lower coils 216 and 218 which electromagnetically drive an armature 220 against the force of upper and lower springs 222 and 224 for controlling movement of the valve 212.

One or more sensors 228, 230, and 232 may be provided for detecting a position, velocity and/or acceleration of armature 220. As one embodiment, at least one of sensors 228, 230, and 232 may include a switch type sensor that detects when armature 220 passes within a region of the sensor. In some embodiments, at least one of sensors 228, 230, and 232 may provide continuous position, velocity, and/or acceleration data to the control system for the armature and/or valve position.

Controller 234, which can be combined into controller 12, or act as a separate controller portion of the control system is shown operatively connected to position sensors 228, 230, and 232, and to the upper and lower coils 216 and 218 to control actuation and landing of valve 212. As described above, engine 10 has one or more electric valve actuators that may be used to vary the lift height, lift duration, and/or opening and closing timing in response to operating conditions of the engine.

FIG. 2C shows an alternative embodiment of an EVA system including a dual coil oscillating mass actuator with an engine valve actuated by a pair of opposing electromagnetic coils (e.g. solenoids), which are designed to overcome the force of a pair of opposing valve springs 242 and 244 arranged differently than the actuator of FIGS. 2A and 2B. Other components of the electric valve actuation system of FIG. 2C may be similar to those of FIGS. 2A and 2B, except that FIG. 2C shows port 250, which can be an intake or exhaust port of a cylinder of the engine. Applying a variable voltage to the coil of the electromagnet induces current to flow, which controls the force produced by each electromagnet. With some EVA systems, each electromagnet that makes up an actuator may be only able to produce a force in one direction, independent of the polarity of the current in its coil.

As illustrated above, the electrically actuated valves in the engine may remain in a half open position when the actuators are de-energized (e.g. no current is supplied). Therefore, prior to a combustion operation of the cylinder, each valve may go through an initialization cycle. During an initialization cycle, the actuators can be pulsed with current, in a prescribed manner, in order to establish the valves in the fully closed or fully open position. Further, as will be described below in greater detail, the initialization cycle may include a determination of a base level of holding current for one or more magnetic coils of the EVA system.

Following this initialization, the valves can be sequentially actuated according to the desired valve timing and firing order by the pair of electromagnetic coils, a first electromagnetic coil (e.g. the lower coil) for pulling the valve open and a second electromagnetic coil (e.g. the upper coil) for pulling the valve closed.

The magnetic properties of each electromagnet may be such that only a single electromagnetic coil (upper or lower) need be energized at any time. Since one of the coils (e.g. the upper coil) holds the valve closed for the majority of each engine cycle, it may be operated for a much higher percentage of time than that of the other coils (e.g. the lower coil).

Referring back to FIG. 1, engine 10 has cam-less independently variable intake and exhaust valves. This methodology could apply to any combination of variable intake and/or exhaust valve trains as well as EVA and mechanically driven valves. The valves are actuated using valve controller 82 where controller 12 may be the vehicle ECU and referred to as the master controller or master ECU. According to one embodiment, controller 12 performs valve timing calculations and delivered to valve controller 82 to be delivered to EVA 51 and EVA 53.

In some embodiments, a computation and transmission latency time can be used as part of a control strategy for sending valve timing information from engine controller 12 to valve controller 82. The latency time may be determined by adding valve timing computation time in controller 12 with the transmission time of the valve timing between controller 12 and controller 82. The latency time is not so restricted, however, and may include only one of the computation time and transmission time, or various combinations of times relevant to delivery of valve timing information and use of that information to actuate valves on engine 10. Use of latency time in a valve control strategy allows a reasonable window of time for the valve timing to reach valve controller 82 and can also provide updates to timing closer to an actual valve transition event. In this way, the delay between computation of valve timing and the delivery of that timing can be reduced, allowing valve timing actuation that is more relevant to current conditions such as intake and exhaust manifold pressures, air charge estimation, fuel charge estimation, driver demands, etc. At relatively slow engine speeds as measured by engine speed sensor 118, valve timing can be transferred close to a valve transition event, but as engine speeds increase, the engine crankshaft 40 will rotate through more degrees during the same latency time.

In this manner, an embodiment valve timing control strategy can utilize engine speed and latency time to ensure valve timing can be calculated and delivered within the aforementioned window. In one example embodiment, valve timing information can be transferred between the controller 12 and valve controller 82 at crank angle intervals of 90 degrees during engine operation, allowing timing information to be delivered for each cylinder combustion event and close to the desired combustion event or valve transition events, but embodiments are not limited to phase shifts of 90 degrees. The present embodiment will be more fully explained below.

Figure 3:
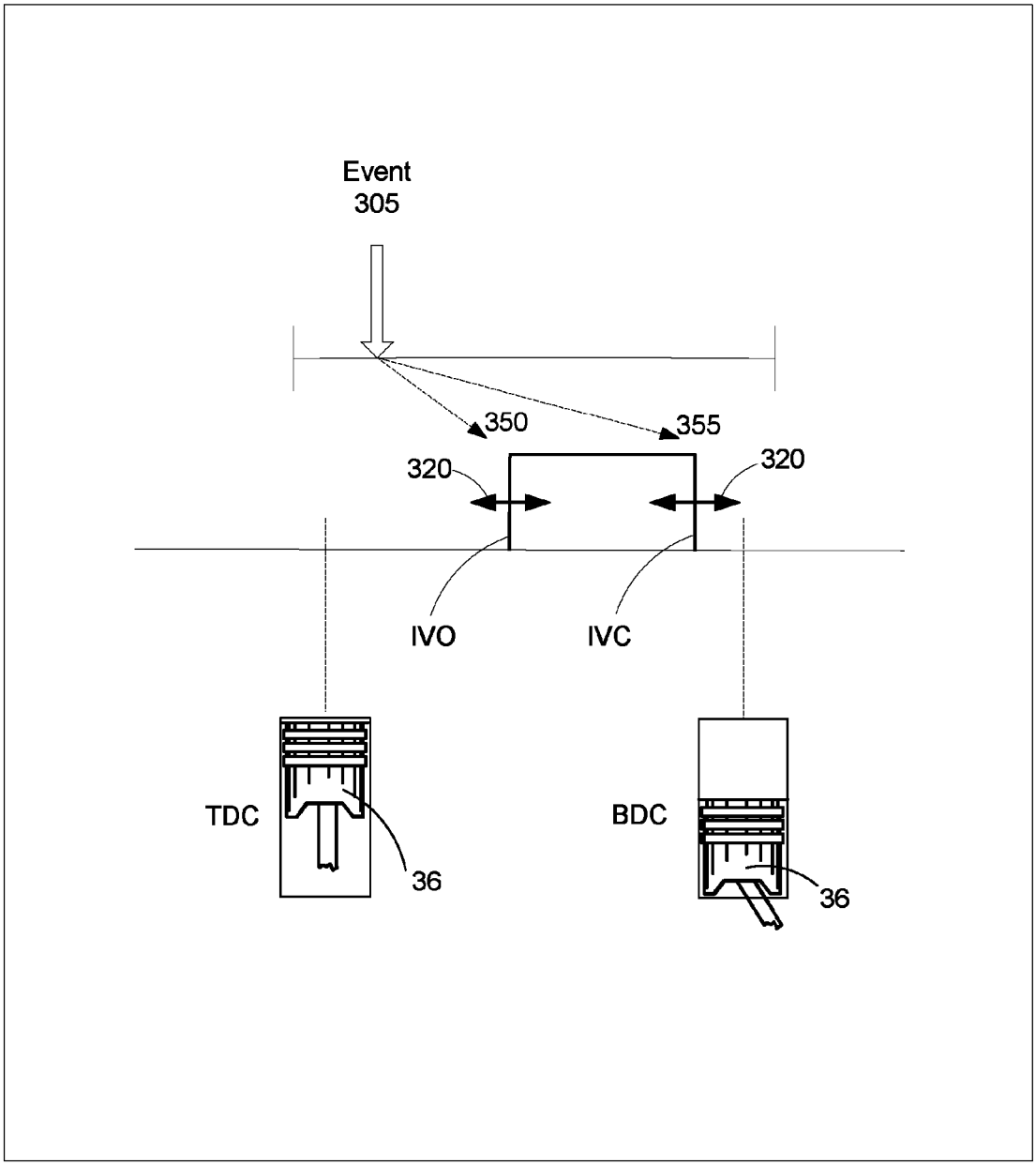
FIG. 3 is a diagram illustrating valve transition events respective to cylinder position as further described in this disclosure.

Some embodiments may send multiple sets of valve timing information. For example, a valve timing control strategy may send a base valve timing from controller 12 to valve controller 82 prior to a valve transition event, and a faster update valve timing relatively close to the respective valve transition event. Referring to FIG. 3, in the current example, a base timing can include an intake valve open (IVO) and intake valve close (IVC) timing, while the fast update valve timing can include IVC timing for the same event 305, such as a valve transition event, cylinder combustion event, etc. FIG. 3 illustrates a valve opening including the IVO and IVC transitions, delivery of valve timings 350 and 355, adjustments to IVO and IVC events 320, which may be an advance or a retardation of timing, and also the corresponding piston 36 positions TDC and BDC. Since the IVC timing can be significantly greater than the IVO timing in crank angle degrees (e.g., IVC can occur a significant number of degrees after IVO), a faster IVC update 355 can even be delivered after an actual IVO event and prior to the IVC event for the same valve opening, cylinder combustion event, etc., for example. In this example, event 305 may be too close to IVO to allow a valve timing delivery 350 within time to advance or retard 320 IVO timing, yet still allow delivery of IVC timing 355 to allow either advancing or retarding 320 IVC timing. Alternatively, the IVC timing may be delivered after it is too late to adjust IVO, although IVO has not yet occurred. Faster IVC updates may adjust valve closing timing either by advancing or retarding the timing. The current example illustrates a base timing with intake valve open and intake valve close events, and a faster update timing with an intake valve close event, but other embodiments may use intake or exhaust valves, valve open events or valve close events, or even other valve or engine events.

The current embodiment, in part, describes fast updates for adjusting valve close timing forward or backward for a valve transition or engine combustion event where a timing was either already delivered to valve controller 82, or a valve has already transitioned. Other embodiments are not so limited. Valve timing may be adjusted in phased intervals and may further be delivered at different times even for portions of valve events such as the beginning or ending of a valve opening or closing, or the start or end of a fully open or fully closed position, etc. For example, for an embodiment using valve timing computation and transmission between controller 12 and valve controller 82, as the latency time, then it is conceivable to adjust timing of a valve transition event within the computation and transmission hardware capacity. In this way, the timing for different valve transition events, or even a portion of these events, can be delivered closer to the calculation of that valve timing but still within a useable time period not too close to the event.

The present embodiment involves determining phase shifts, in 90 degree intervals indexed to intake top dead center (TDC), prior to the intake TDC of the target cylinder at which the base IVO, IVC timing and the fast update IVC timing can be delivered. The phase shifts for the base timing may be different than that for the fast update timing. Other embodiments may use different intervals, and be indexed to different cylinder or valve timing events, and still be within the scope of this disclosure.

Figure 4:
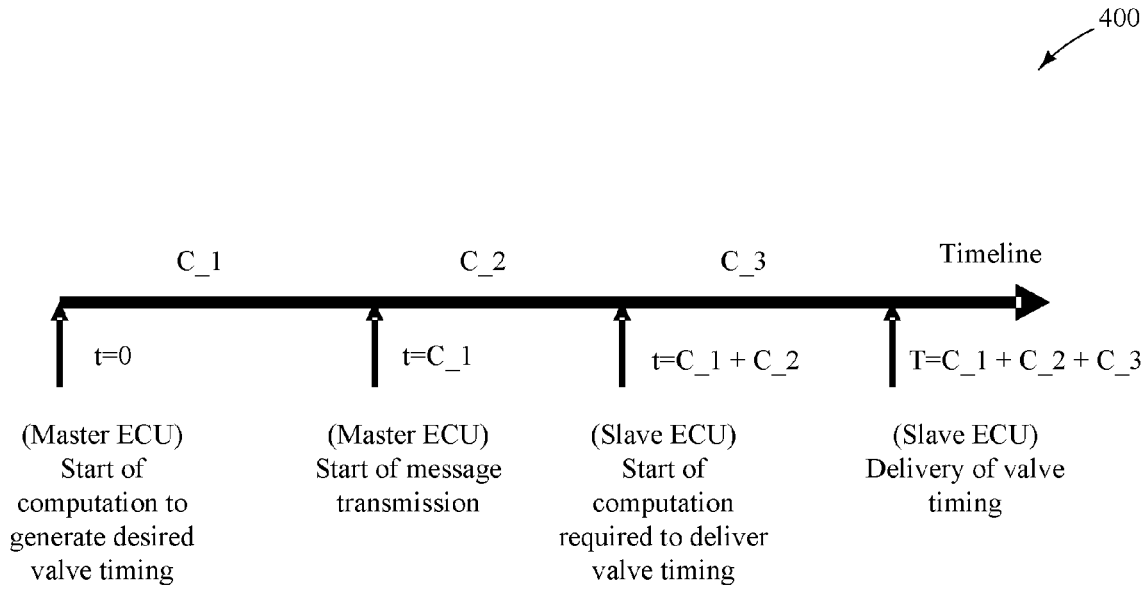
FIG. 4 is a timing diagram illustrating computation and transmission latencies for valve timing information.

FIG. 4 is a timeline 400 illustrating computation and transmission latencies for valve timing information. In the current embodiment, the transmission of valve timing data between controller 12 and valve controller 82 occurs at 90 degree crankshaft 40 angle intervals where the valve timing transmission lines up with the intake TDC of piston 36 in cylinder 30. The controller 12 computation time for determining desired timing is C_1, for example C_1 milliseconds. Continuing this metric, the transmission time through the CAN interface 85 is nominally C_2 milliseconds. And finally, the computation time required by valve controller 82 to deliver the received timing information to electronic valve actuators 51 and 53 through links 86 and 87 is C_3 milliseconds.

Figure 5:
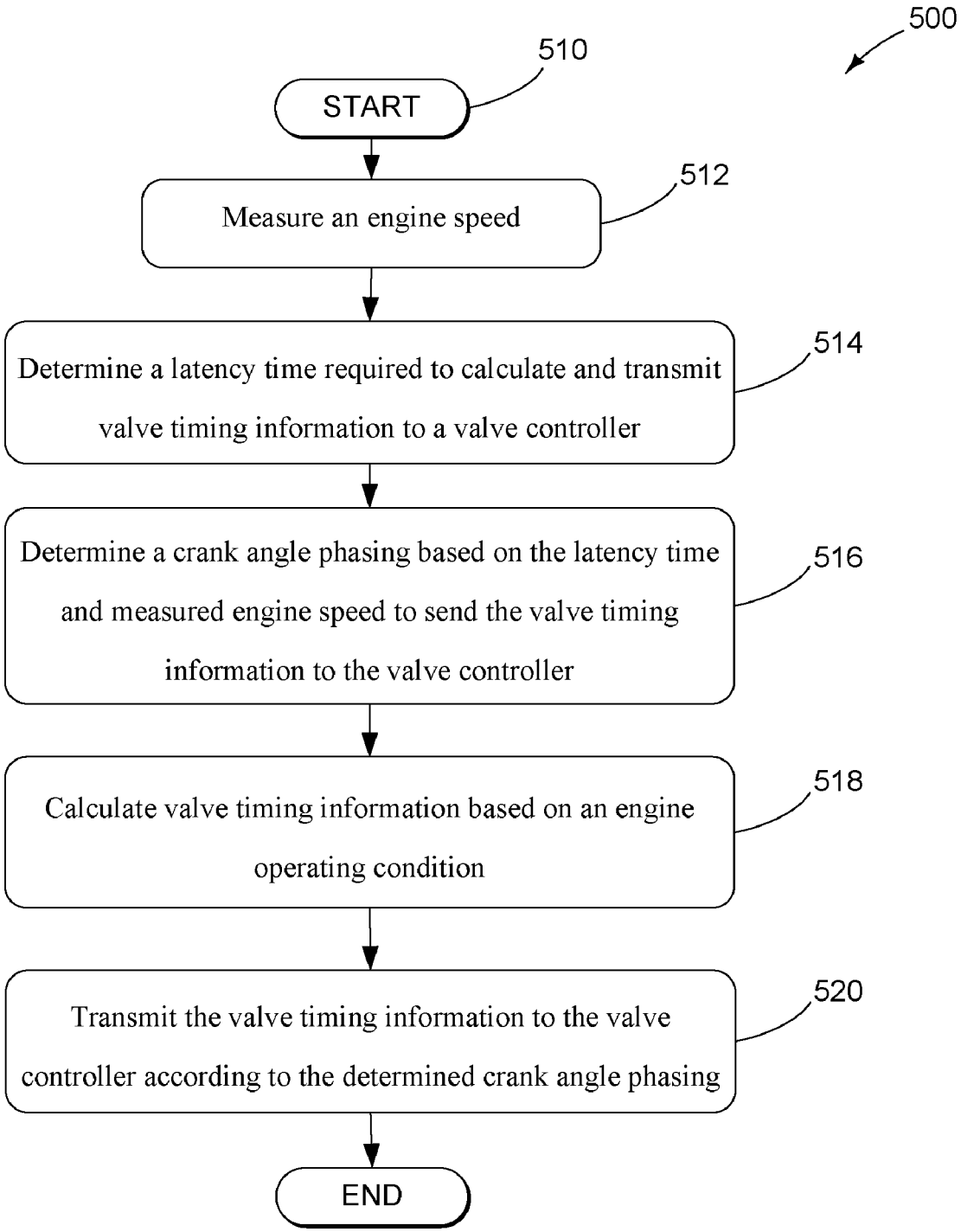
FIG. 5 is a flow diagram of an embodiment method to determine a crank angle phasing for valve timing based on engine speed.

FIG. 5 is a flow diagram of an embodiment method 500 to determine a crank angle phasing for valve timing based on engine speed. According to example method 500, an engine speed is measured in block 512. Other embodiments may measure the speed of portions of an engine 10, engine relative position, or other metrics that allow coordination of valve timing information and computation and transmission latency times. In block 514, method 500 determines a latency time required to calculate and transmit valve timing information to a valve controller 82. In the example illustrated in FIG. 4, this latency time may be C_2 which is determined by adding valve timing computation time in controller 12 with the transmission time of the valve timing between controller 12 and controller 82, but other embodiments are not so limited.

Referring back to FIG. 5, in block 516, crank angle phasing is used to coordinate sending of valve timing information to the valve controller 82 and the crank angle phasing is determined based on the latency time and measured engine speed from engine speed sensor 118. In block 518, method 500 calculates valve timing information based on an engine 10 operating condition and in block 520 transmits the valve timing information to the valve controller 82 according to the determined crank angle phasing.

An example crank angle phasing as calculated in block 516 follows. This example illustrates a base and a fast update valve timing phasing calculation and is further illustrated in FIG. 6. These example calculations use the variables defined below. Other embodiments may use different calculations and remain within the principles of this disclosure.

Variables:

N=engine speed

T=C_1+C_2 from FIG. 4)

V=N*3.9/650

IVO_min(N)=minimum IVO at a given engine speed over all engine loads

IVC_min(N)=minimum IVC at a given engine speed over all engine loads

TDCs base=base IVO,IVC timing 90 degree crank angle phase shifts

TDCs_fast="fast" IVC timing 90 degree crank angle phase shifts

M=number of engine cylinders

Y=reference TDC intake crank angle

Figure 6:
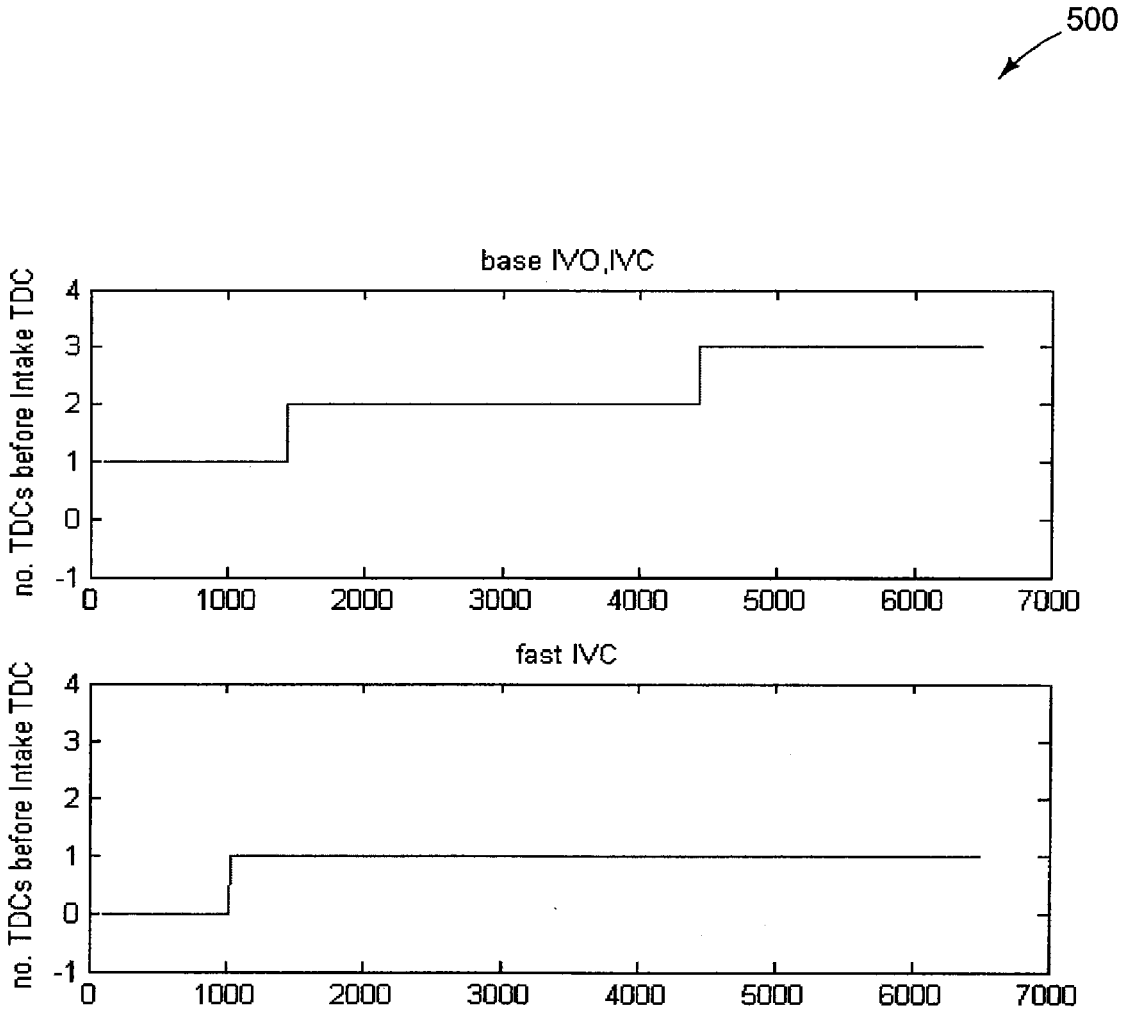
FIG. 6 is a graph illustrating base and fast crank angle interval phasing for an intake valve.

Example Calculations:

The present example computes phase shifts using the following procedures as illustrated in FIG. 6. Other calculations may be used and still be within the scope of this disclosure.

Base IVO, IVC phasing

```
TDCs_base = 1;
while (IVO_min(N) − (Y − 720/M*TDCs_ivo) < (T+4)*V),
   TDCs_base = TDCs_base + 1;
   if (TDCs_base > M−1), break; end;
end
```

Fast IVC phasing

```
TDCs_fast = −2;
while (IVC_min(N) − V*4 − ((Y − 720/M*TDCs_ivc) + V*T) < 0),
   TDCs_fast = TDCs_fast + 1;
   if (TDCs_fast > M−1), break; end;
end
```

FIG. 6 is a graph illustrating base and fast crank angle interval phasing for an intake valve according to the example phasing calculations above. Embodiments may include or apply to any combination of variable intake and/or exhaust valve trains, FIG. 6 illustrates an intake valve embodiment by way of example only. As an example, for a V8 engine with C_1=1 ms, C_2 based on 3 8-byte messages transferred over 500 kbit/sec (High Speed) CAN link, and C_3=4 ms, the phasing is distributed over a range of engine speed as illustrated in FIG. 6. Using these example calculations, the base IVO, IVC timings are transmitted at 90 degree crank angle phasing intervals of 1 from 0 to approximately 1500 revolutions per minute (rpm), and then 2 intervals from approximately 1500 rpm to 4500 rpm, and 3 phasing intervals from approximately 4500 rpm and higher engine speeds. In the present example, the fast IVC timings are sent with no full intervals until 1000 rpm and at 1 interval at higher engine speeds than 1000 rpm. These example intervals are calculated as the number of top dead center positions for the target cylinder before the intake top dead center corresponding to the actual valve transition event. Other embodiments may be indexed to other cylinder or engine positions and other calculations or variables can produce other crank angle interval phasing.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various steps, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated steps or functions may be repeatedly performed depending on the particular strategy being used. Further, the described steps may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

I claim:

1. A system for controlling a multiple cylinder internal combustion engine with electromagnetic valve actuation, comprising:

at least one cylinder with an engine cylinder valve;

a valve slave controller operably coupled to the engine cylinder valve, said controller to adjust valve opening and/or closing timing of the engine cylinder valve;

a master controller connected to the valve slave controller with a link, the master controller to:

send a first valve timing command signal to the valve slave controller to control the valve for a combustion event;

send a second valve timing command signal to the valve slave controller to control the valve for said combustion event, said second valve timing command signal sent after sending said first valve timing command signal; and adjust a timing of sending said first and second valve timing command signals with engine speed.

2. The method of claim 1, wherein the first valve timing command adjusts at least a valve open timing.

3. The system of claim 1, wherein the second valve timing command adjusts at least a valve close timing.

4. The system of claim 1, wherein the second valve timing command is transmitted after a valve is opened according to the first valve timing command.

5. The system of claim 1, wherein a crank angle phasing is in 90 crank angle degree intervals.

6. The system of claim 5, wherein the 90 crank angle degree intervals are indexed to top dead center of a target cylinder.

7. The system of claim 1, wherein the valve timing is calculated based on an engine operating condition.

8. The system of claim 1, wherein the link is a control area network (CAN) link.

9. A method for controlling an internal combustion engine having a plurality of cylinders using electronic valve actuation, comprising:

measuring an engine speed;

determining a latency time required to calculate and transmit a first valve timing to a valve controller;

determining a first crank angle phasing based on the latency time and measured engine speed to send the first valve timing to the valve controller;

determining a second crank angle phasing based on the latency time and measured engine speed to send a second valve timing to update the valve controller; and transmitting the first valve timing to the valve controller according to the first crank angle phasing and transmitting the second valve timing to the valve controller according to the second crank angle phasing.

10. The method of claim 9, wherein the first valve timing includes valve open and close timing.

11. The method of claim 9, wherein the second valve timing includes valve close timing.

12. The method of claim 9, wherein the second valve timing is transmitted after a valve is opened according to the first valve timing.

13. The method of claim 9, wherein the crank angle phasing is in 90 crank angle degree intervals indexed to top dead center of a target cylinder.

14. The method of claim 9, further comprising calculating valve timing based on an engine operating condition.

15. A method for controlling an internal combustion engine having a plurality of cylinders using electronic valve actuation, comprising:

measuring an engine speed;

determining a latency time required to calculate and transmit valve timing information to a valve controller;

determining a crank angle phasing based on the latency time and measured engine speed to send the valve timing information to the valve controller;

calculating valve timing information based on an engine operating condition; and transmitting the valve timing information to the valve controller according to the determined crank angle phasing.

16. The method of claim 15, wherein the first valve timing includes valve open and close timing.

17. The method of claim 15, wherein the first valve timing includes at least one of intake and exhaust valve timing.

18. The method of claim 15, wherein the crank angle phasing is in 90 crank angle degree intervals.

19. The method of claim 18, wherein the 90 crank angle degree intervals are indexed to top dead center of a target cylinder.

20. The method of claim 15, further comprising calculating valve timing based on an engine operating condition.

* * * * *